US011708689B2

(12) United States Patent
Mathews

(10) Patent No.: US 11,708,689 B2
(45) Date of Patent: Jul. 25, 2023

(54) TOILET FLAP VALVE ASSEMBLY

(71) Applicant: Charley Mathews, Indianapolis, IN (US)

(72) Inventor: Charley Mathews, Indianapolis, IN (US)

( * ) Notice: Subject to any disclaimer, the term of this patent is extended or adjusted under 35 U.S.C. 154(b) by 75 days.

(21) Appl. No.: 17/508,360

(22) Filed: Oct. 22, 2021

(65) Prior Publication Data

US 2023/0129477 A1 Apr. 27, 2023

(51) Int. Cl.
*E03D 11/10* (2006.01)
*E03F 7/06* (2006.01)

(52) U.S. Cl.
CPC ..... *E03D 11/10* (2013.01); *E03F 7/06* (2013.01)

(58) Field of Classification Search
CPC ..... E03D 11/10; E03F 7/06
USPC ..... 4/252.1
See application file for complete search history.

(56) References Cited

U.S. PATENT DOCUMENTS 1,397,471 A 11/1921 Walker
1,654,832 A * 1/1928 Pohl ..... E03D 11/10 43/131
2,089,141 A 8/1937 Wasserman
3,393,408 A * 7/1968 Martin ..... E03D 11/00 43/61
3,545,010 A * 12/1970 Beebe ..... E03D 11/10 43/61
4,642,935 A 2/1987 Fierer
D701,589 S 3/2014 Praher
2005/0060795 A1* 3/2005 Long ..... E03F 7/06 4/252.4
2009/0008588 A1* 1/2009 Giehl ..... E03F 7/04 251/157
2010/0192483 A1* 8/2010 Nilsson ..... E03F 7/06 52/101
2011/0272052 A1* 11/2011 Lauridsen ..... E03F 7/06 29/428
2014/0144065 A1 5/2014 Mardirossian
2018/0044906 A1* 2/2018 McAlpine ..... E03F 7/06
2018/0171616 A1* 6/2018 Singbeil ..... E03D 11/10
2020/0248825 A1* 8/2020 Bouchard ..... F16K 15/03

FOREIGN PATENT DOCUMENTS

EP 2385179 5/2011

* cited by examiner

*Primary Examiner* — Benjamin R Shaw

(57) ABSTRACT

A toilet flap valve assembly includes a band that is comprised of a resiliently bendable material thereby facilitating the band to be formed into a closed loop that is positionable in a trap of a toilet bowl. A flap is movably attachable to the band when the band is formed into the closed loop. The flap is foraminous to pass liquid therethrough and the flap is normally positioned in a closed position having the flap closing the closed loop. The flap is only openable in a direction of flow in the trap to inhibit an animal from entering the toilet from a sewer line. The flap is urgeable into an open position in the direction of flow in the trap to facilitate solid waste to flow through the trap when the toilet is flushed.

9 Claims, 5 Drawing Sheets

TOILET FLAP VALVE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to flap valve devices and more particularly pertains to a new flap valve device for inhibiting an animal from entering a toilet bowl from a sewer line. The device includes a band which is formed into a closed loop thereby facilitating the band to be positioned in an entrance of a trap in a toilet. The device includes a foraminous flap that is hingedly coupled to the band. The foraminous flap inhibits the animal from entering the toilet while facilitating solid waste to be flushed in the toilet.

(2) Description of Related Art Including Information Disclosed Under 37 CFR 1.97 and 1.98

The prior art relates to flap valve devices including a flap that is hingedly positioned within a sewer line to inhibit an animal from passing through the sewer line. The prior art discloses a sewer trap which includes a flap that is pivotally integrated into the sewer trap. The prior art discloses a variety of rodent barriers that are positioned in a trap in a toilet that has a diameter which is greater than the diameter of the trap and which can be opened in only direction. The prior art discloses a rodent trap that includes a sleeve that is positionable in a trap of a toilet and a flap that is pivotally coupled to the sleeve.

BRIEF SUMMARY OF THE INVENTION

An embodiment of the disclosure meets the needs presented above by generally comprising a band that is comprised of a resiliently bendable material thereby facilitating the band to be formed into a closed loop that is positionable in a trap of a toilet bowl. A flap is movably attachable to the band when the band is formed into the closed loop. The flap is foraminous to pass liquid therethrough and the flap is normally positioned in a closed position having the flap closing the closed loop. The flap is only openable in a direction of flow in the trap to inhibit an animal from entering the toilet from a sewer line. The flap is urgeable into an open position in the direction of flow in the trap to facilitate solid waste to flow through the trap when the toilet is flushed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
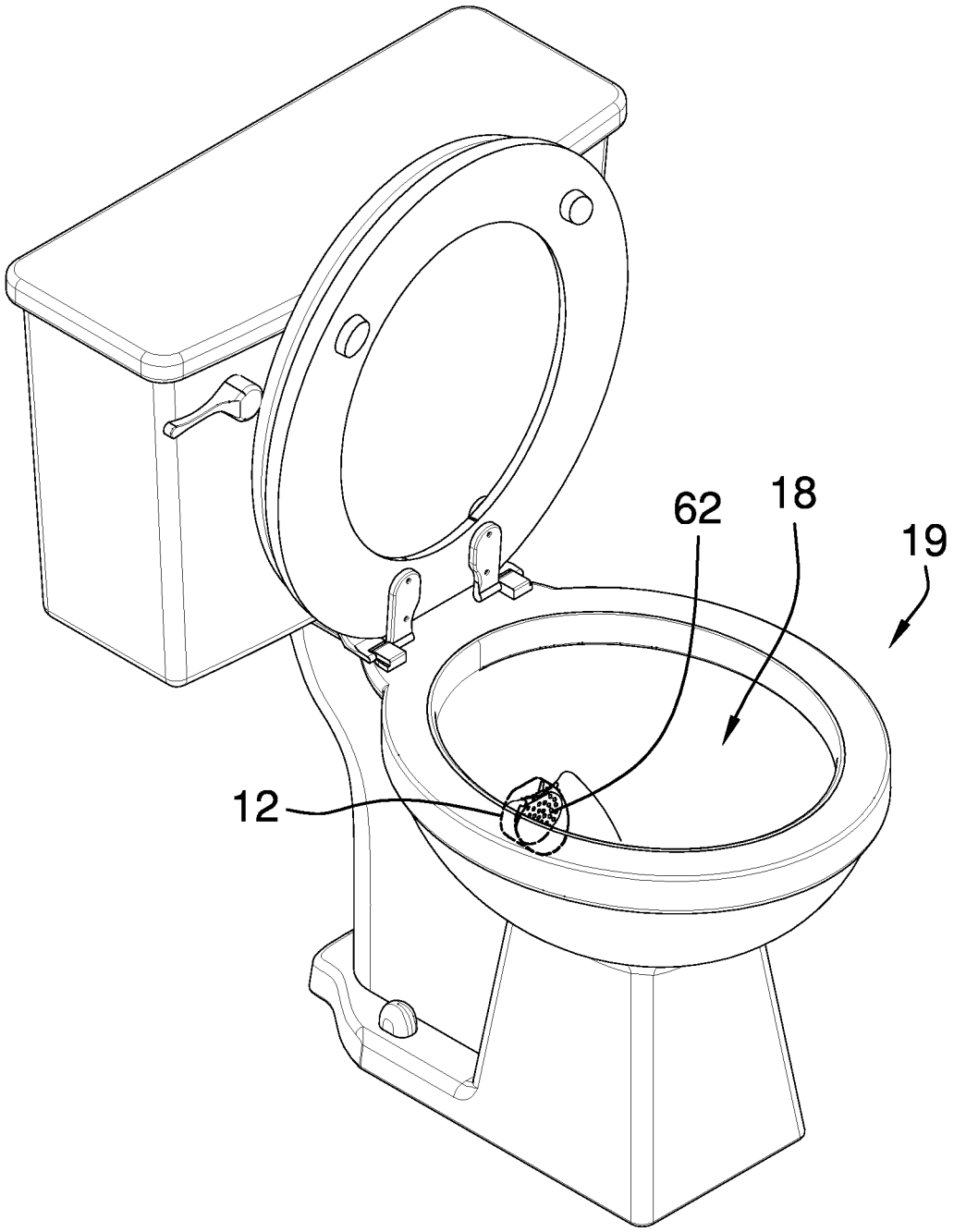
FIG. 1 is a perspective in-use view of a toilet flap valve assembly according to an embodiment of the disclosure.
Figure 2:
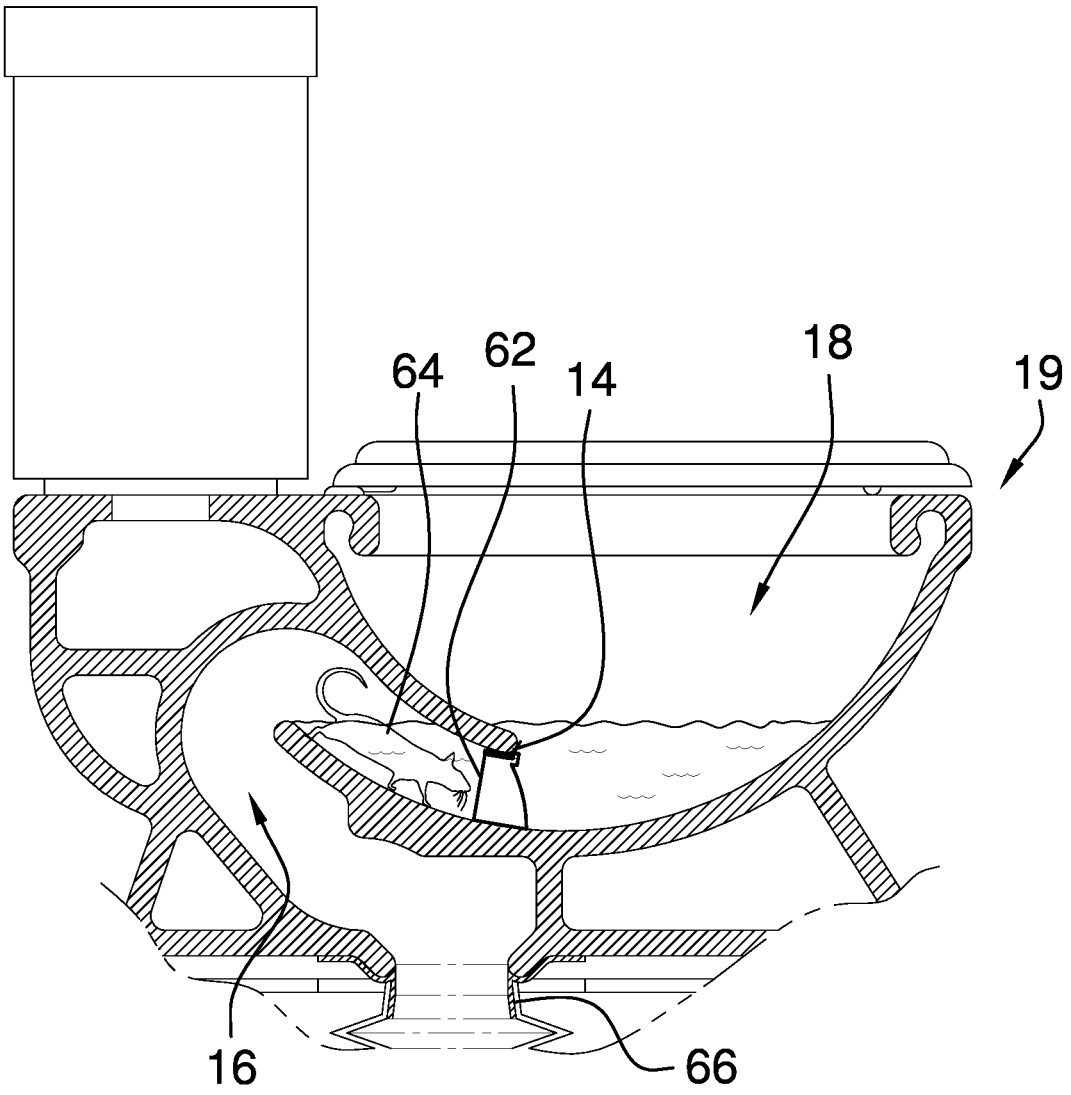
FIG. 2 is a left side cut-away view of an embodiment of the disclosure.
Figure 3:
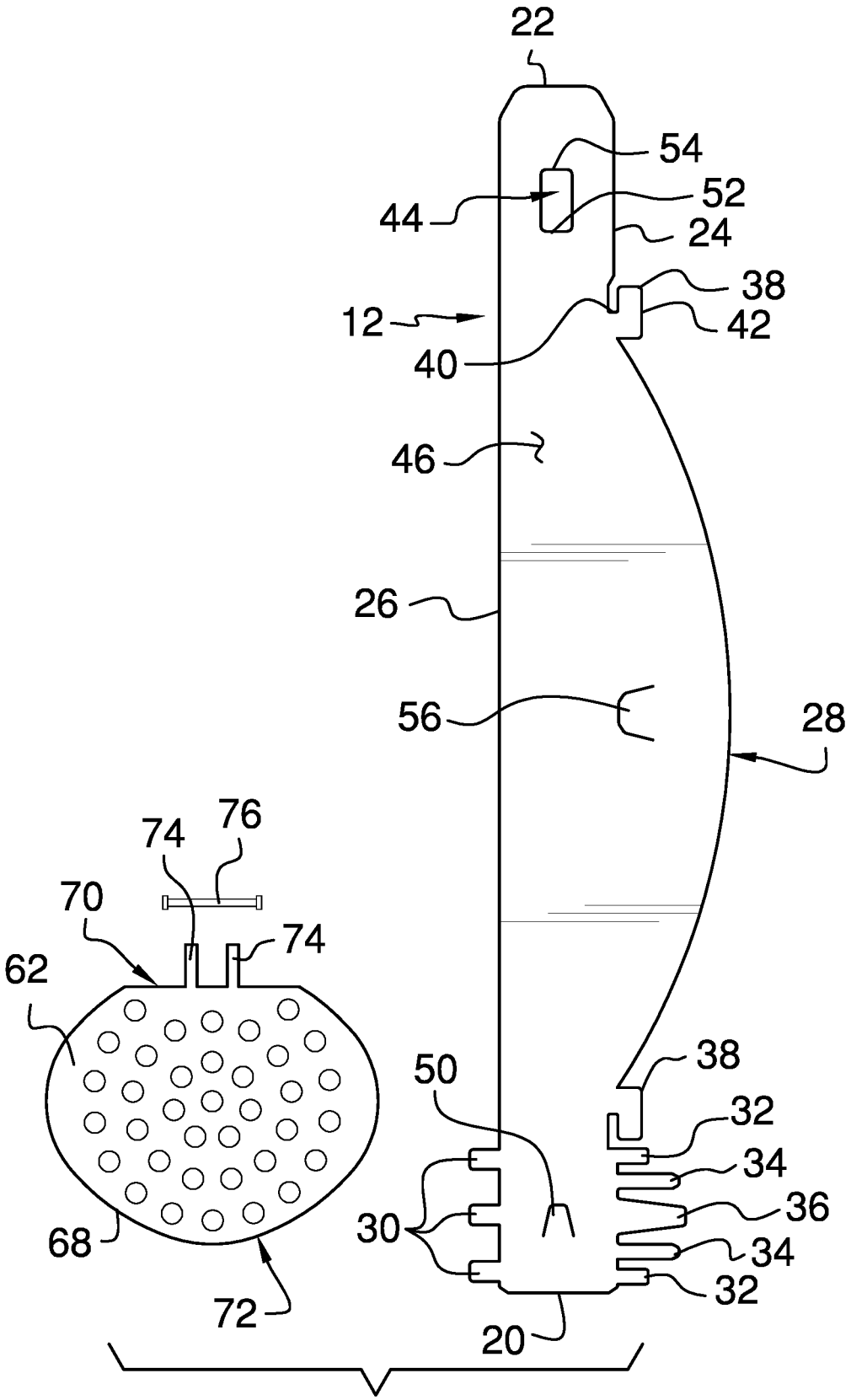
FIG. 3 is an exploded perspective view of an embodiment of the disclosure.
Figure 4:
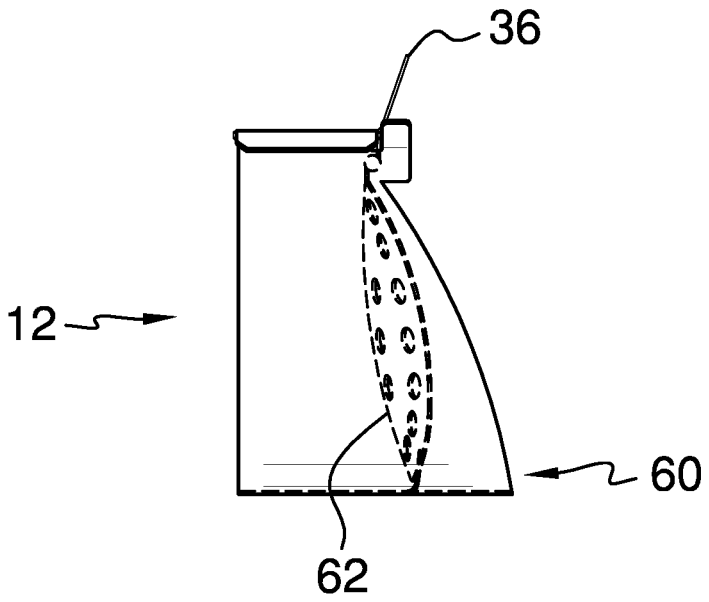
FIG. 4 is a right side phantom view of an embodiment of the disclosure.
Figure 5:
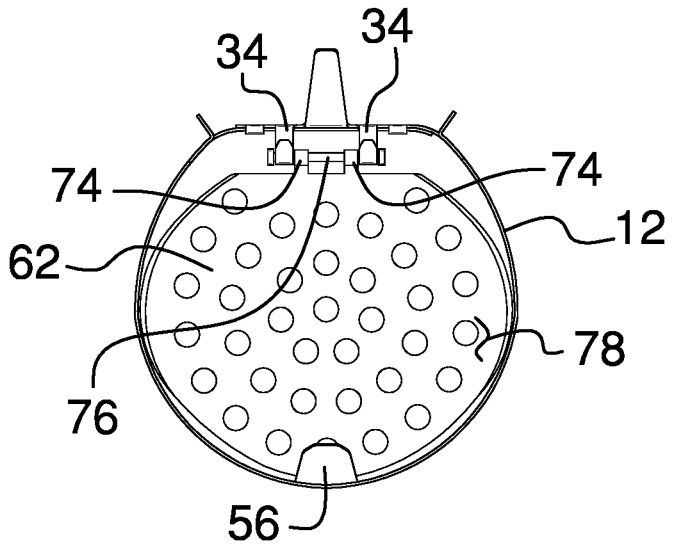
FIG. 5 is a front view of an embodiment of the disclosure.
Figure 6:
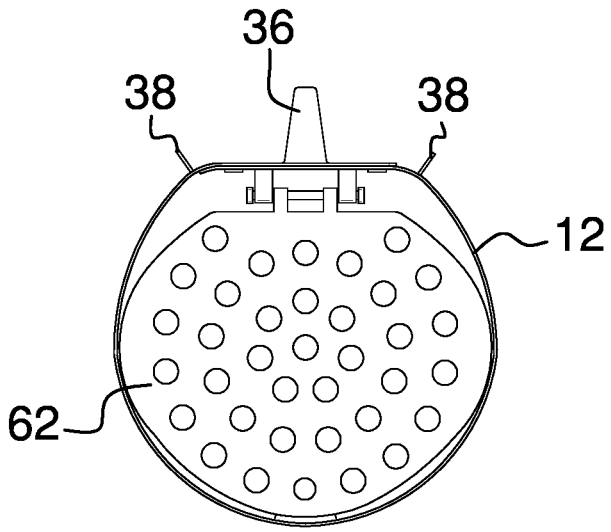
FIG. 6 is a back view of an embodiment of the disclosure.
Figure 7:
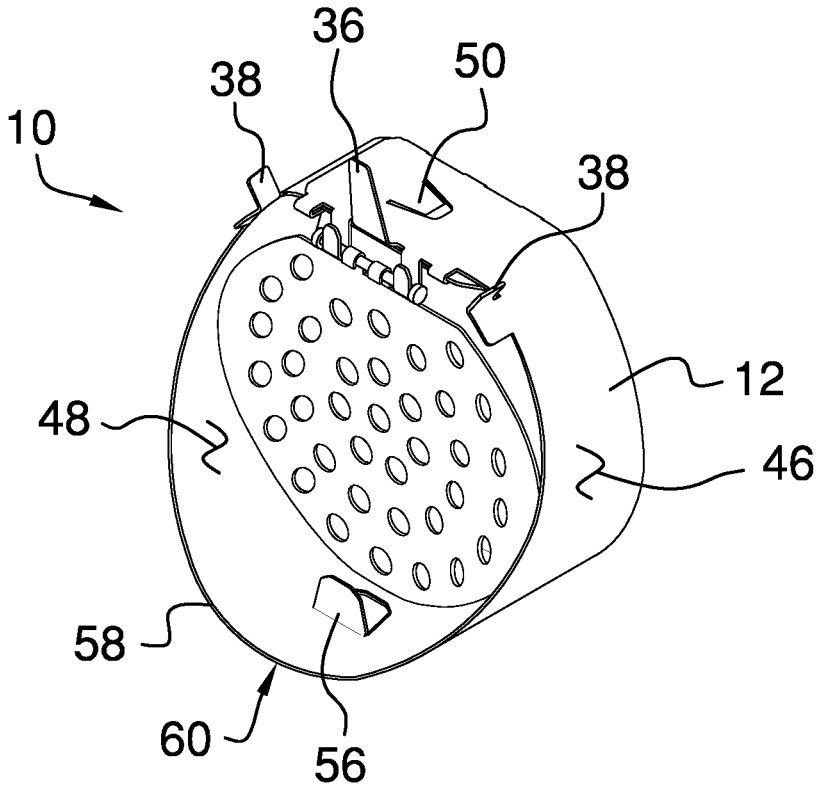
FIG. 7 is a perspective in-use view of an embodiment of the disclosure.

With reference now to the drawings, and in particular to FIGS. 1 through 7 thereof, a new flap valve device embodying the principles and concepts of an embodiment of the disclosure and generally designated by the reference numeral 10 will be described.

As best illustrated in FIGS. 1 through 7, the toilet flap valve assembly 10 generally comprises a band 12 that is comprised of a resiliently bendable material thereby facilitating the band 12 to be formed into a closed loop. In this way the band 12 can be positioned in an entrance 14 of a trap 16 of a toilet bowl 18 of a toilet 19. The toilet 19 may be a plumbing fixture of any conventional design that would commonly be employed in residential structure. The band 12 has a first end 20, a second end 22, a front edge 24 and a back edge 26, and the band 12 is elongated between the first end 20 and the second end 22. The front edge 24 has a curved portion 28 which curves away from the back edge 26, and the curved portion 28 is centrally positioned between the first end 20 and the second end 22.

The back edge 26 has a plurality of first tabs 30 each extending away from the back edge 26, and the first tabs 30 are positioned adjacent to the first end 20. Each of the first tabs 30 is bendable onto the band 12 when the band 12 doubled onto itself to form the closed loop for retaining the band 12 in the closed loop. The front edge 24 has a pair of second tabs 32 each extending away from the front edge 24 and each of the second tabs 32 is positioned between the curved portion 28 and the first end 20. Each of the second tabs 32 is bendable onto the bend when the band 12 is doubled onto itself to form the closed loop for retaining the band 12 in the closed loop.

The front edge 24 has a pair of hinge tabs 34 each extending away from the front edge 24, and each of the hinge tabs 34 is positioned between the pair of second tabs 32. The front edge 24 has a locking tab 36 extending away from the front edge 24, and the locking tab 36 is positioned between the pair of hinge tabs 34. The front edge 24 has a pair of grip tabs 38 each extending away from the front edge 24, and each of the grip tabs 38 is positioned between the curved portion 28 and a respective one of the first end 20 and the second end 22 of the band 12. Each of the grip tabs 38 comprises a leg 40 extending away from the front edge 24 and a foot 42 extending toward the respective first end 20 or second end 22. The foot 42 on each of the grip tabs 38 is bent upwardly when the band 12 is formed into the closed loop such that each of the grip tabs 38 can be gripped.

The band 12 has an opening 44 extending through a first surface 46 and a second surface 48 of the band 12, and the opening 44 is positioned adjacent to the second end 22. The band 12 has a closure tab 50 that is integrated into the band 12 and the closure tab 50 is positioned adjacent to the first end 20. The closure tab 50 is bendable to extend upwardly from the band 12 thereby facilitating the closure tab 50 to extend through the opening 44 when the band 12 is formed into the closed loop. Additionally, the band 12 is biased to expand into the largest possible diameter of the closed loop.

The closure tab 50 abuts a first bounding edge 52 of the opening 44 when each of the grip tabs 38 are urged toward each other for compressing the closed loop into a minimum diameter. In this way the band 12 can be inserted into an entrance 14 of a trap 16 in the toilet 19 when the band 12 is formed into the closed loop. The closure tab 50 abuts a second bounding edge 54 of the opening 44 when the band 12 expands. In this way the band 12 can compress against the entrance 14 of the trap 16 for retaining the band 12 in the trap 16.

The band 12 includes a stop tab 56 that is integrated into the band 12 and the stop tab 56 is centrally positioned between the first end 20 and the second end 22. The stop tab 56 is bendable to extend into the closed loop formed by the band 12. Conversely, the locking tab 36 is bendable to extend away from the closed loop formed by the band 12. In this way the locking tab 36 abuts a threshold of the entrance 14 into the trap 16 to inhibit the band 12 from passing through the trap 16 when the toilet 19 is flushed. An apex 58 of the curved portion 28 of the front edge 24 defines a lower lip 60 of the closed loop when the band 12 is formed into the closed loop. Additionally, the lower lip 60 is spaced forwardly from each of the hinge tabs 34 when the band 12 is formed into the closed loop.

A flap 62 is movably attachable to the band 12 when the band 12 is formed into the closed loop. Additionally, the flap 62 is oriented perpendicular to a direction of flow in the trap 16 in the toilet 19. The flap 62 is foraminous to pass liquid therethrough and the flap 62 is normally positioned in a closed position having the flap 62 closing the closed loop. The flap 62 only is openable in a direction of flow in the trap 16 to inhibit an animal 64 from entering the toilet 19 from a sewer line 66. Conversely, the flap 62 is urgeable into an open position in the direction of flow in the trap 16 to facilitate solid waste to flow through the trap 16 when the toilet 19 is flushed.

The flap 62 has an outer edge 68 and the outer edge 68 has a top portion 70 and a lower portion 72. The top portion 70 is flattened and the lower portion 72 is curved such that the flap 62 has a rounded shape. The top portion 70 has a pair of fingers 74 each extending upwardly from the top portion 70, and the fingers 74 are spaced apart from each other. A pin 76 is provided and each of the fingers 74 is curled around the pin 76 such that the flap 62 is movably attached to the pin 76. Each of the hinge tabs 34 on the front edge 24 of the band 12 is curled around the pin 76 for pivotally coupling the flap 62 to the closed loop formed by the band 12. The flap 62 has a front surface 78, and the front surface 78 of the flap 62 abuts the stop tab 56 when the flap 62 is in the closed position. In this way the stop tab 56 inhibits the flap 62 from being opened against the direction of flow in the toilet 19.

In use, the pair of grip tabs 38 is squeezed together and the closed loop formed by the band 12 is inserted into the entrance 14 of the trap 16 in the toilet 19. The grip tabs 38 are released thereby facilitating the closed loop to expand against the entrance 14 in the trap 16 of the toilet 19. The flap 62 is inhibited from being opened by an animal 64, such as a sewer rat or a snake that attempts to pass through the trap 16 from the sewer line 66. In this way the animal 64 is inhibited from entering the toilet bowl 18. The flap 62 is urged into the open position when solid waste is flushed in the toilet 19 thereby facilitating the toilet 19 to function normally. The grip tabs 38 can be squeezed together for removing the closed loop from the trap 16 at any time for any purpose.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet flap valve assembly for inhibiting animals from entering a toilet through a sewer line, said assembly comprising:

a band being comprised of a resiliently bendable material thereby facilitating said band to be formed into a closed loop wherein said band is configured to be positioned in a trap of a toilet bowl; and a flap being movably attachable to said band when said band is formed into said closed loop wherein said flap is configured to be oriented perpendicular to a direction of flow in the trap in the toilet, said flap being foraminous wherein said flap is configured to pass liquid therethrough, said flap being normally positioned in a closed position having said flap closing said closed loop, said flap only being openable in a direction of flow in the trap wherein said flap is configured to inhibit an animal from entering the toilet from a sewer line, said flap being urgeable into an open position in the direction of flow in the trap wherein said flap is configured to facilitate solid waste to flow through the trap when the toilet is flushed.

2. The assembly according to claim 1, wherein:

said band has a first end, a second end, a front edge and a back edge, said band being elongated between said first end and said second end, said front edge having a curved portion which curves away from said back edge, said curved portion being centrally positioned between said first end and said second end;

said back edge has a plurality of first tabs each extending away from said back edge, said first tabs being positioned adjacent to said first end, each of said first tabs being bendable onto said band when said band doubled onto itself to form said closed loop for retaining said band in said closed loop; and said front edge has a pair of second tabs each extending away from said front edge, each of said second tabs being positioned between said curved portion and said first end, each of said second tabs being bendable onto said bend when said band is doubled onto itself to form said closed loop for retaining said band in said closed loop.

3. The assembly according to claim 2, wherein:

said front edge has a pair of hinge tabs each extending away from said front edge, each of said hinge tabs being positioned between said pair of second tabs;

said front edge has a locking tab extending away from said front edge, said locking tab being positioned between said pair of hinge tabs, said locking tab is bendable to extend away from said closed loop formed by said band wherein said locking tab is configured to abut a threshold of the entrance into the trap for inhibiting said band from passing through the trap when the toilet is flushed; and said front edge has a pair of grip tabs each extending away from said front edge, each of said grip tabs being positioned between said curved portion and a respective one of said first end and said second end of said band, each of said grip tabs comprising a leg extending away from said front edge and a foot extending toward said respective first end or second end, said foot on each of said grip tabs being bent upwardly when said band is formed into said closed loop wherein each of said grip tabs is configured to be gripped.

4. The assembly according to claim 2, wherein:

said band has an opening extending through a first surface and a second surface of said band, said opening being positioned adjacent to said second end; and said band has a closure tab being integrated into said band, said closure tab being positioned adjacent to said first end, said closure tab being bendable to extend upwardly from said band thereby facilitating said closure tab to extend through said opening when said band is formed into said closed loop.

5. The assembly according to claim 4, wherein said closure tab abuts a first bounding edge of said opening when each of said grip tabs are urged toward each other for compressing said closed loop into a minimum diameter wherein said band is configured to be inserted into an entrance of a trap in the toilet, said band being biased to expand into the largest possible diameter of said closed loop, said closure tab abutting a second bounding edge of said opening when said band expands wherein said band is configured to compress against the entrance of the trap for retaining said band in the trap.

6. The assembly according to claim 3, wherein an apex of said curved portion of said front edge defining a lower lip of said closed loop when said band is formed into said closed loop, said lower lip being spaced forwardly from each of said hinged tabs when said band is formed into said closed loop.

7. The assembly according to claim 1, wherein said flap has an outer edge, said outer edge having a top portion and a lower portion, said top portion being flattened, said lower portion being curved such that said flap has a rounded shape, said top portion having a pair of fingers each extending upwardly from said top portion, said fingers being spaced apart from each other.

8. The assembly according to claim 7, wherein:

said band has a pair of hinge flaps each being positioned on a front edge of said band;

said band has a stop tab being bendable upwardly from said band; and said assembly includes a pin having each of said fingers being curled around said pin such that said flap is movably attached to said pin, each of said hinge tabs on said front edge of said band being curled around said pin for pivotally coupling said flap to said closed loop formed by said band, said flap having a front surface, said front surface of said flap abutting said stop tab when said flap is in said closed position such that said stop tab inhibits said flap from being opened against the direction of flow in the toilet.

9. A toilet flap valve assembly for inhibiting animals from entering a toilet through a sewer line, said assembly comprising:

a band being comprised of a resiliently bendable material thereby facilitating said band to be formed into a closed loop wherein said band is configured to be positioned in a trap of a toilet bowl, said band having a first end, a second end, a front edge and a back edge, said band being elongated between said first end and said second end, said front edge having a curved portion which curves away from said back edge, said curved portion being centrally positioned between said first end and said second end, said back edge having a plurality of first tabs each extending away from said back edge, said first tabs being positioned adjacent to said first end, each of said first tabs being bendable onto said band when said band doubled onto itself to form said closed loop for retaining said band in said closed loop, said front edge having a pair of second tabs each extending away from said front edge, each of said second tabs being positioned between said curved portion and said first end, each of said second tabs being bendable onto said bend when said band is doubled onto itself to form said closed loop for retaining said band in said closed loop, said front edge having a pair of hinge tabs each extending away from said front edge, each of said hinge tabs being positioned between said pair of second tabs, said front edge having a locking tab extending away from said front edge, said locking tab being positioned between said pair of hinge tabs, said front edge having a pair of grip tabs each extending away from said front edge, each of said grip tabs being positioned between said curved portion and a respective one of said first end and said second end of said band, each of said grip tabs comprising a leg extending away from said front edge and a foot extending toward said respective first end or second end, said foot on each of said grip tabs being bent upwardly when said band is formed into said closed loop wherein each of said grip tabs is configured to be gripped, said band having an opening extending through a first surface and a second surface of said band, said opening being positioned adjacent to said second end, said band having a closure tab being integrated into said band, said closure tab being positioned adjacent to said first end, said closure tab being bendable to extend upwardly from said band thereby facilitating said closure tab to extend through said opening when said band is formed into said closed loop, said band being biased to expand into the largest possible diameter of said closed loop, said closure tab abutting a first bounding edge of said opening when each of said grip tabs are urged toward each other for compressing said closed loop into a minimum diameter wherein said band is configured to be inserted into an entrance of a trap in the toilet, said closure tab abutting a second bounding edge of said opening when said band expands wherein said band is configured to compress against the entrance of the trap for retaining said band in the trap, said band having a stop tab being integrated into said band, said stop tab being centrally positioned between said first end and said second end, said stop tab being bendable to extend into said closed loop formed by said band, said locking tab being bendable to extend away from said closed loop formed by said band wherein said locking tab is configured to abut a threshold of the entrance into the trap for inhibiting said band from passing through the trap when the toilet is flushed, an apex of said curved portion of said front edge defining a lower lip of said closed loop when said band is formed into said closed loop, said lower lip being spaced forwardly from each of said hinged tabs when said band is formed into said closed loop;

a flap being movably attachable to said band when said band is formed into said closed loop wherein said flap is configured to be oriented perpendicular to a direction of flow in the trap in the toilet, said flap being foraminous wherein said flap is configured to pass liquid therethrough, said flap being normally positioned in a closed position having said flap closing said closed loop, said flap only being openable in a direction of flow in the trap wherein said flap is configured to inhibit an animal from entering the toilet from a sewer line, said flap being urgeable into an open position in the direction of flow in the trap wherein said flap is configured to facilitate solid waste to flow through the trap when the toilet is flushed, said flap having an outer edge, said outer edge having a top portion and a lower portion, said top portion being flattened, said lower portion being curved such that said flap has a rounded shape, said top portion having a pair of fingers each extending upwardly from said top portion, said fingers being spaced apart from each other; and a pin having each of said fingers being curled around said pin such that said flap is movably attached to said pin, each of said hinge tabs on said front edge of said band being curled around said pin for pivotally coupling said flap to said closed loop formed by said band, said flap having a front surface, said front surface of said flap abutting said stop tab when said flap is in said closed position such that said stop tab inhibits said flap from being opened against the direction of flow in the toilet.

* * * * *